US006959644B2

(12) United States Patent
Hertzog et al.

(10) Patent No.: US 6,959,644 B2
(45) Date of Patent: Nov. 1, 2005

(54) METHOD FOR SECURING A MOUNTING BAR AT ONE END OF A PRINTING BLANKET AND RESULTING PRINTING BLANKET

(75) Inventors: Denis Hertzog, Berrwiller (FR); Patrick Mauget, Cierrey (FR)

(73) Assignee: Macdermid Graphic Arts S.A., Cernay (FR)

( * ) Notice: Subject to any disclaimer, the term of this patent is extended or adjusted under 35 U.S.C. 154(b) by 0 days.

(21) Appl. No.: 10/474,258

(22) PCT Filed: Apr. 11, 2002

(86) PCT No.: PCT/FR02/01273

§ 371 (c)(1),
(2), (4) Date: Mar. 16, 2004

(87) PCT Pub. No.: WO02/083421

PCT Pub. Date: Oct. 24, 2002

(65) Prior Publication Data

US 2004/0159256 A1 Aug. 19, 2004

(30) Foreign Application Priority Data

Apr. 12, 2001 (FR) ..... 01 05044

(51) Int. Cl.[7] ..... B41F 27/00

(52) U.S. Cl. ..... 101/384; 101/382.1

(58) Field of Search ..... 101/384, 383, 101/382.1, 378, 375, 368, 415.1

(56) References Cited

FOREIGN PATENT DOCUMENTS

WO WO 95/21061 8/1995

*Primary Examiner*—Anthony H. Nguyen
(74) *Attorney, Agent, or Firm*—Leydig, Voit & Mayer, Ltd.

(57) ABSTRACT

A method for securing a mounting bar at one end of a blanket including a lithographic layer and a support layer and, interposed between those two layers, at least one reinforcing woven layer. The end of the blanket, where the bar is to be fixed, is stripped until the main or single reinforcement of the blanket is exposed and the bar is fixed at least on the stripped part on the end of the blanket. The invention is applicable to printing machines.

10 Claims, 2 Drawing Sheets

METHOD FOR SECURING A MOUNTING BAR AT ONE END OF A PRINTING BLANKET AND RESULTING PRINTING BLANKET

FIELD OF THE INVENTION

The invention relates to a process for securing a mounting bar to one end of a printing blanket which has a lithographic layer and a compressible layer, and at least one woven reinforcing layer between the lithographic layer and the compressible layer, and the invention relates to a blanket thus obtained.

BACKGROUND

The blankets of the prior art, as described in the document EP 0 742 760, for example, are gripped at both ends in a mounting bar that bears on the free surfaces of the two exterior layers.

It is known that the mechanical performance of the mounting bars is of prime importance in printing machines. In effect, loss of the bar by possible unseating of it can have very serious consequences, with possible breaking of the printing cylinders and loss of production for the user.

SUMMARY OF THE INVENTION

The present invention proposes a process for securing a mounting bar to a blanket that increases the mechanical performance of the mounting bars and eliminates the above-mentioned risk.

In order to attain this aim, in the process according to the invention, the end of the blanket on which a mounting bar is to be secured is stripped until the main reinforcement or sole reinforcement of the blanket is free, and the mounting bar is secured to the reinforcement.

According to one characteristic of the invention, the mounting bar is secured to the reinforcement by gluing.

According to one characteristic of the invention, both surfaces of the beam are stripped, and the mounting bar is secured by gluing to the two exposed surfaces of the beam.

A printing blanket according to the invention has at least one surface of the reinforcement stripped, and the mounting bar is secured by gluing to this surface.

According to another characteristic of the invention, the mounting bar has the shape of a flat strip.

According to yet another characteristic of the invention, the mounting bar has an L-shaped profile wherein one limb is glued onto the exposed beam portion.

According to yet another characteristic of the invention, the mounting bar has a U-shaped profile wherein one limb is glued on one exposed surface of a beam.

According to yet another characteristic of the invention, the two surfaces of the beam are stripped, and each limb of the mounting bar is glued on one of the two exposed surfaces of the beam.

BRIEF DESCRIPTION OF THE DRAWINGS

The invention will be better understood, and other aims, characteristics, details and advantages of it will appear more clearly in the following explanatory description with reference to the appended schematic drawings, given only as an example illustrating an embodiment of the invention, and in which.

DETAILED DESCRIPTION

Figure 1:
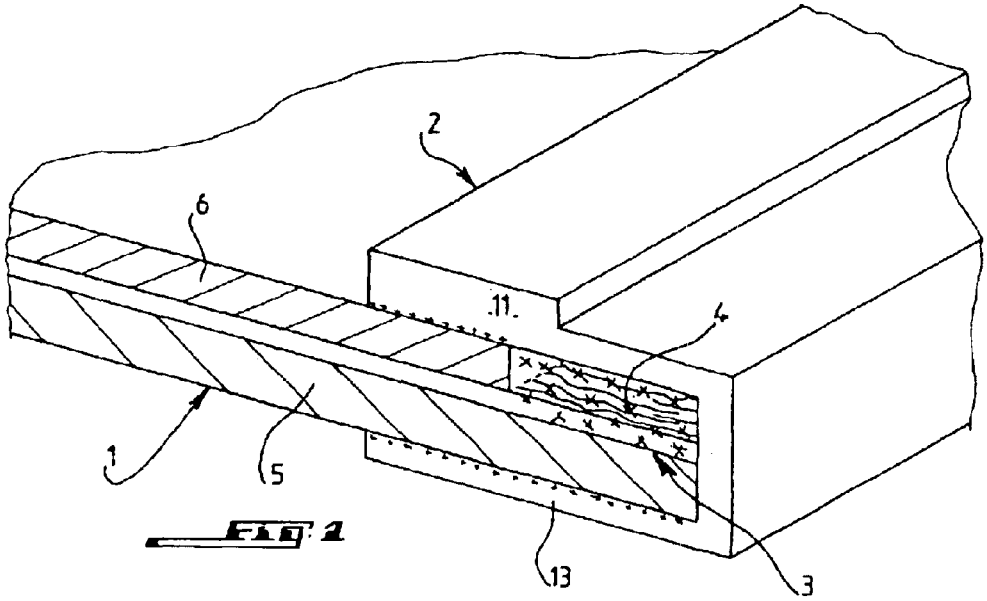
FIG. 1 is an oblique view of an end of a blanket according to the invention.

FIG. 1 shows one end of blanket 1 onto which mounting bar 2 is mounted by gluing, the bar having a general U shape in which end 3 of the blanket is engaged. This blanket in FIG. 1 has three layers, namely exterior lithographic layer 5, exterior base layer 6, and, inserted between these two layers, reinforcing layer 7 which comprises a main or sole reinforcement, such as beam 8. In the part of end 3 of the blanket that is taken between the two limbs of rod 2, layer 6 is removed at 9 in order to expose beam 8, as will be described in detail further on. The glue indicated at 4 and which is used as a means of securing the mounting bar to end 3 of the blanket is arranged directly on the beam in zone 9. Thus, a part of upper limb 11 of the mounting bar is secured, by means of a layer of glue, at its front part to the exterior surface and at its end part to the beam 8, while the other limb 13 of the mounting bar is secured to the exterior surface of lithographic layer 5.

Figure 2:
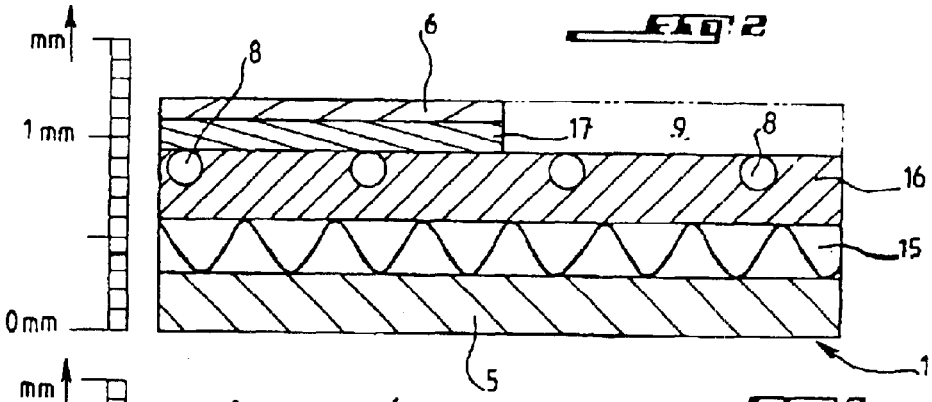
FIGS. 2 and 3 illustrate two blanket structures that are particularly suitable for application of the invention.
Figure 3:
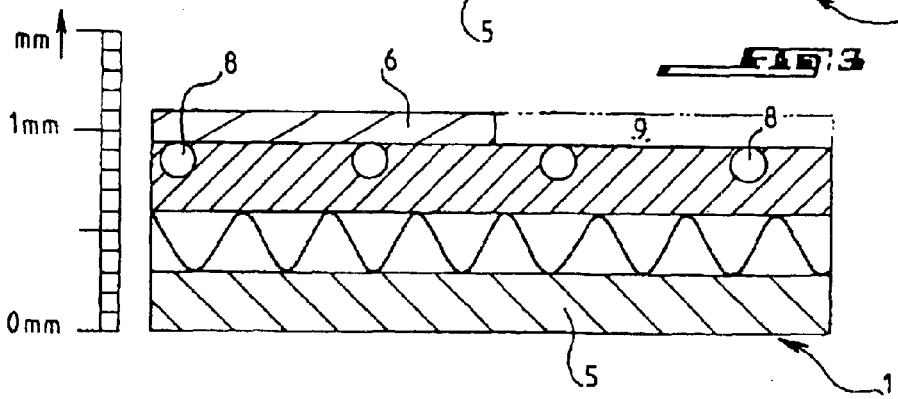

Blanket 1 represented in FIG. 2 could in reality have a structure such as is illustrated in FIG. 2 or FIG. 3. In the example of FIG. 2, between lithographic layer 5 and opposite exterior layer 6, which is a slightly compressible polymer layer, the blanket has stabilizing fabric layer 15, compressible layer 16 into which beam 8 is integrated, and compact polymer layer 17, the beam being arranged inside layer 16 on the layer 17 side. The blanket according to FIG. 3 is distinguished from the blanket represented in FIG. 2 by the fact that compact polymer layer 17 has been eliminated. Consequently, the blanket of FIG. 3 can have a smaller thickness of 1.1 mm in comparison with the 1.2 mm of the blanket according to FIG. 2. Of course, the invention applies also to blankets of standard thickness, generally between 1.35 and 2.35 mm.

FIGS. 2 and 3 show the blanket after beam 8 has been stripped at part 9, the original contour of end 3 being represented by a broken line.

Figure 4:
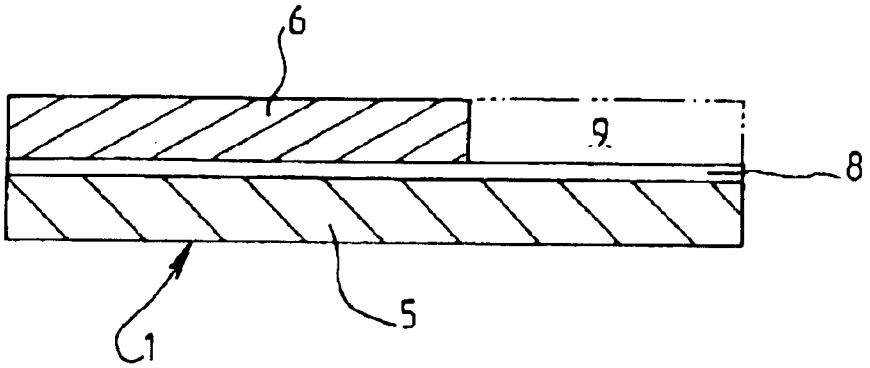
FIGS. 4 to 6 are diagrammatic views illustrating three steps of the process according to the invention.
Figure 5:
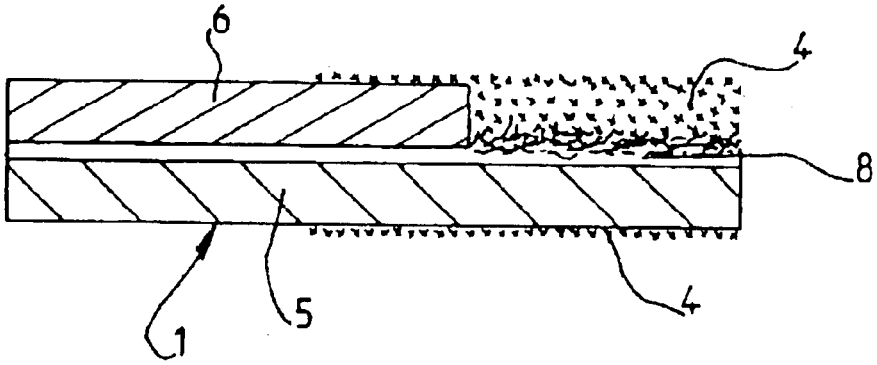
Figure 6:
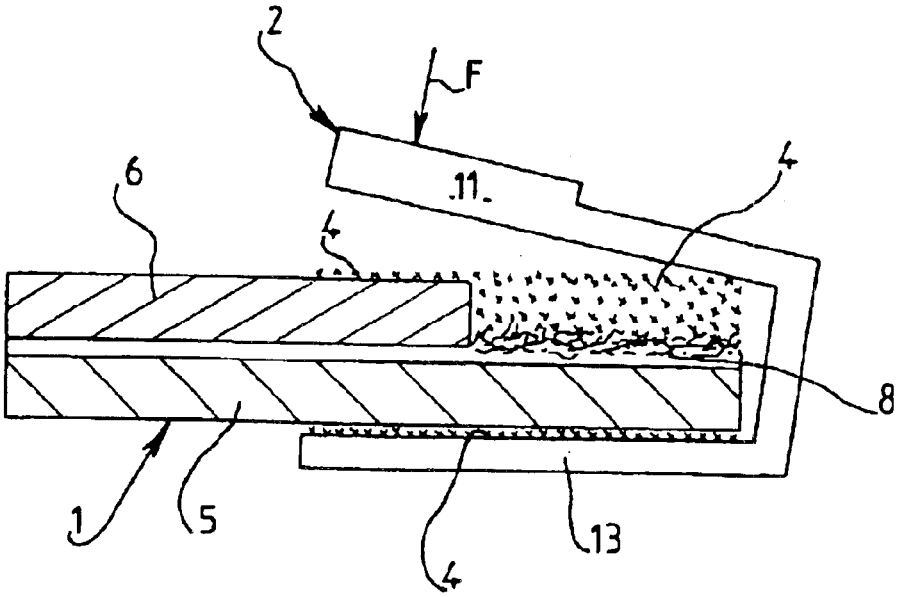

FIGS. 4 to 6 show three steps of the process for mounting of bar 2 onto end 3 of blanket 1. In a first steps, represented in FIG. 4, a part of the thickness of the blanket is delaminated over an appropriate width in order to expose the wires which provide the stretch resistance of the blanket, that is to say, in general the aramid beam 8. Advantageously, the exposed surface as well as the rest of the surface which is to be glued can be prepared for gluing or for molding by washing with solvents or by mechanical brushing or the equivalent. Then, in a second operation, the beam thus exposed is coated with glue as illustrated in FIG. 5. After spreading the glue, one proceeds to mount bar 2 on end 3 of the blanket. FIG. 6 shows the mounting bar in its position before the effective gluing. Then, by application of a force in the direction of arrow F, limb 11 of the bar is forced towards the exterior surface to the position shown in FIG. 1. After hardening of the glue, a high degree of resistance to pull-out is obtained, which is necessary for mounting the blanket on an offset printing cylinder.

As an example, the blanket can be stripped for a distance of, for example, 1 to 20 mm, and the blanket can be grasped by mounting bars with a length, width or depth of between 5 and 30 mm.

It should be noted that a number of modifications can be made to the embodiment described and represented. Thus, the blanket can be stripped on both surfaces simultaneously until freeing of the wires which provide the stretch resistance of the blanket. It is also possible to use a simple bar, for example, a bar in the form of a flat rod or a bar with an L-shaped profile, which will then be secured to the exposed, glue-covered surface of the strengthening wires. As a variant, the bar can be molded onto the stripped blanket. The bar can be made of metal but also of composite material, of thermoplastic reinforced, or not, by fibers or by a metallic mesh.

The invention can be used for blankets with a single reinforcement, blankets with two lithographic layers, blankets with a polymer backing, and blankets with thinned ends, as described, for example, in the document FR 9900828.

The above-mentioned single reinforcement can consist of an aramid beam, a beam produced with other fibers with a high modulus and high strength, a known fabric with different weaves, or else a mesh or a plastic film.

The invention also applies to a blanket of more conventional design and which, if necessary, has more than one reinforcement in its body.

What is claimed is:

1. A process for securing a mounting bar to one end of a printing blanket which includes a lithographic layer, a base layer, and, inserted between the lithographic and base layers, at least one woven reinforcing layer, the process including stripping an end of the blanket onto which a mounting bar is to be secured, until a reinforcement of the blanket is exposed, and securing the mounting bar at least on an exposed part of the reinforcement.

2. The process according to claim 1, including spreading glue on at least the exposed part of the reinforcement and gluing the reinforcement to the bar.

3. The process according to claim 2, including exposing two opposite surfaces of the reinforcement, and gluing the mounting bar to the two exposed surfaces of the reinforcement.

4. The process according to claim 1, including molding the mounting bar onto the blanket after exposing the reinforcement.

5. A printing blanket obtained according to the process of claim 1, in which at least one surface of the reinforcement is exposed, and the mounting bar is glued to the surface of the reinforcement.

6. The blanket according to claim 5, wherein the mounting bar is a flat rod.

7. The blanket according to claim 5, wherein the mounting bar has an L-shaped profile and one limb of the mounting bar is glued to the exposed surface of the reinforcement.

8. The blanket according to claim 5, wherein the mounting bar has a U-shaped profile, wherein one limb of the mounting bar is glued to one exposed surface of the reinforcement.

9. The blanket according to claim 8, wherein two surfaces of the reinforcement are exposed, and each limb of the mounting bar is glued to a respective one of the two surfaces of the reinforcement.

10. The blanket according to claim 5, wherein the mounting bar is molded to the blanket.

* * * * *